United States Patent [19]

Ueda

[11] Patent Number: 4,913,373

[45] Date of Patent: Apr. 3, 1990

[54] METHOD OF OPERATING AN AUTOMATIC WINDER IN CHANGING YARN LOT

[75] Inventor: Yutaka Ueda, Nara, Japan

[73] Assignee: Murata Kikai Kabushiki Kaisha, Kyoto, Japan

[21] Appl. No.: 256,962

[22] Filed: Oct. 13, 1988

[30] Foreign Application Priority Data

Oct. 19, 1987 [JP] Japan ..... 62-261540

[51] Int. Cl.[4] ..... B65H 67/06

[52] U.S. Cl. ..... 242/35.5 A; 242/36

[58] Field of Search ..... 242/35.5 A, 35.5 R, 242/35.6 R, 36, 39

[56] References Cited

U.S. PATENT DOCUMENTS

| | | | |
|---|---|---|---|
| 4,634,066 | 1/1987 | Matsui et al. | 242/35.5 A |
| 4,660,370 | 4/1987 | Matsui et al. | 242/35.5 A X |
| 4,681,231 | 7/1987 | Ueda et al. | 242/35.5 A X |
| 4,804,151 | 2/1989 | Kathke | 242/36 X |
| 4,809,919 | 3/1989 | Ueda et al. | 242/35.5 R |

*Primary Examiner*—Stanley N. Gilreath

*Attorney, Agent, or Firm*—Spensley Horn Jubas & Lubitz

[57] ABSTRACT

In an automatic winder, feed of bobbins of the succeeding yarn lot is started at time when the quantity of yarn remaining bobbins of the preceding yarn lot supplied to the winding units is diminished below the quantity of yarn which can be wound by all winding units, to rewind the bobbins of the preceding yarn lot and those of the succeeding yarn lot simultaneously.

18 Claims, 9 Drawing Sheets

METHOD OF OPERATING AN AUTOMATIC WINDER IN CHANGING YARN LOT

FIELD OF THE INVENTION AND RELATED ART STATEMENT

The present invention relates to a method of operating an automatic winder in changing yarn lot, capable of improving the operating efficiency of the automatic winder in changing yarn lot.

In changing yarn lot on an automatic winder, it has been a conventional practice to feed bobbins of the succeeding yarn lot to the automatic winder after all the yarn packages of the preceding yarn lot in process has been rewound. Since yarn packages in process respectively on the winding units of the automatic winder are not equal in size, many short yarn packages, namely, yarn packages smaller than a full yarn package, are produced in rewinding bobbins of a yarn lot. At the final stage of rewinding bobbins of a yarn lot, the winding unit is stopped when the bobbin on the winding unit is exhausted and there are no more bobbins left. Therefore, many winding units remain inoperative for a long time until all the bobbins are exhausted.

As mentioned previously, when the automatic winder is operated by the conventional method of operating an automatic winder in changing yarn lot, in which bobbins of the succeeding yarn lot are supplied to the automatic winder after the completion of rewinding all the bobbins of the preceding yarn lot, many short yarn packages are produced and many winding units must remain inoperative for a long time.

OBJECT AND SUMMARY OF THE INVENTION

It is an object of the present invention to provide a method of operating an automatic winder in changing yarn lot, capable reducing short yarn packages to a minimum and capable of preventing the reduction of the operating efficiency of the automatic winder.

A method of operating an automatic winder in changing yarn lot according to embodiments of the present invention is applicable to an automatic winder having a plurality of winding units each provided with a bobbin selecting mechanism capable of discriminating a bobbin of the succeeding yarn lot from that of the preceding yarn lot and selectively taking an appropriate bobbin into the corresponding winding unit.

According to embodiments of the present invention, feed of bobbins of the succeeding yarn lot to the automatic winder is started at time when the quantity of yarn remaining on bobbins of the preceding yarn lot supplied to the winding unit is diminished below the quantity of yarn which can be wound by all winding units of the automatic winder, to rewind the bobbins of the preceding yarn lot and those of the succeeding yarn lot simultaneously on the automatic winder.

Then, every time a full yarn package of the preceding yarn lot is doffed from a winding unit after the time above mentioned, a command to rewind bobbins of the succeeding yarn lot and winding conditions are given to the same winding unit.

Then, the remaining bobbins of the preceding yarn lot on the same winding unit are removed and are transferred to other winding unit still in operation for rewinding bobbins of the preceding yarn lot, and then the mode of operation of the bobbin selecting mechanism is changed over from a mode for selecting a bobbin of the preceding yarn lot to a mode for selecting a bobbin of the succeeding yarn lot to start rewinding bobbins of the succeeding yarn lot on winding unit where the full package is doffed.

Remaining bobbins of the preceding yarn lot in process on a winding unit are removed upon the completion of winding up a full yarn package on the same winding unit instead of rewinding the remaining bobbins in a short yarn package on the same winding unit, and the remaining bobbins removed from the winding unit are fed to other winding unit still in winding operation for rewinding the remaining bobbins of the preceding yarn lot having insufficient yarn for completing a full yarn package of the preceding yarn lot. Consequently, less short yarn packages of the preceding yarn lot are produced in changing the preceding yarn lot for the succeeding yarn lot.

Furthermore, since the remaining bobbins of the preceding yarn lot are removed from a winding unit when a full yarn package of the preceding yarn lot is finished after the time when the feed of bobbins of the succeeding yarn lot is started, and bobbins of the succeeding yarn lot are fed to the same winding unit to operate the same winding unit continuously, the operating efficiency of the automatic winder is not reduced in changing the preceding yarn lot to the succeeding yarn lot.

DETAILED DESCRIPTION OF THE PREFERRED EMBODIMENTS

A method of operating an automatic winder in changing yarn lot, in a preferred embodiment, according to the present invention will be described hereinafter with reference to the accompanying drawings.

Figure 1:
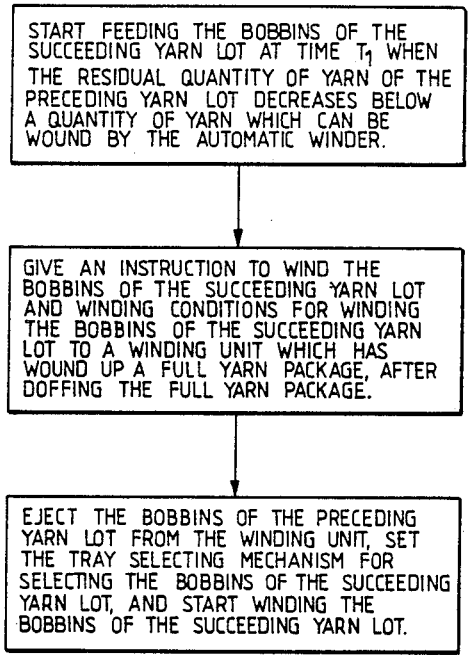
FIG. 1 is a flow chart of assistance in explaining the general conception of a method of operating an automatic winder in changing yarn lot.

A general conception of a method of operating an automatic winder in changing yarn lot is illustrated in FIG. 1. $T_1$ is time when the residual quantity of yarn of the preceding yarn lot decreases below a quantity of yarn which can be wound by all winding units of an automatic winder and is time when a lot changing operation is started.

Figure 5:
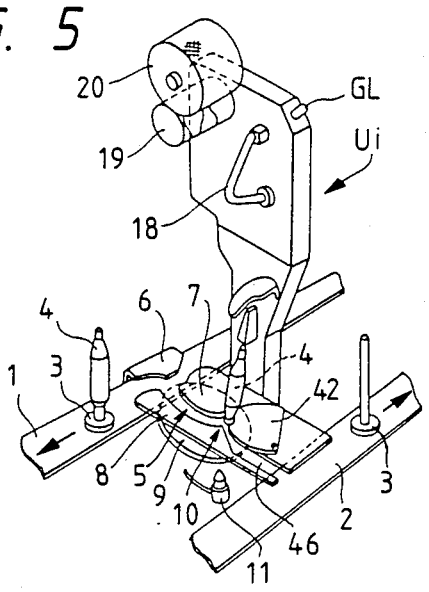
FIG. 5 is a schematic perspective view of a winding unit.
Figure 6:
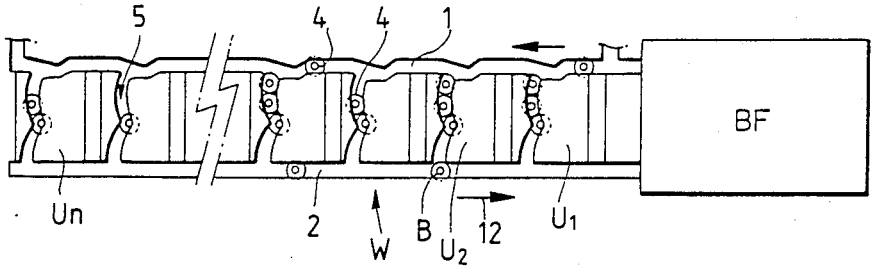
FIG. 6 is a schematic plan view showing the layout of a bobbin conveying system employed in the automatic winder.

Referring to FIGS. 5 and 6 showing an automatic winder W to which an embodiment of the present invention is applied, the automatic winder W has a plurality of winding units $U_i$ (i=1, 2, . . ., n) arranged in a row. A spinning bobbin conveying path 1 and an empty bobbin conveying path 2 are extended respectively on the opposite sides of the row of the winding units $U_i$. As best shown in FIG. 5, a spinning bobbin 4 mounted on a tray 3 is taken automatically into a feed path 5 formed in each winding unit $U_i$ by means of guide plates 6, 7 and 8 and a rotary disk 9 to stock the feed path 5 with a fixed number of spinning bobbins 4, for example, three spinning bobbins. An air nozzle 11 connected to a compressed air source, not shown, is disposed below a bobbin placed at a rewinding position 10 to blow compressed air through an air passage formed in the tray 3 into the bore of the take-up tube of the spinning bobbin 4 placed at the rewinding position 10, and thereby a yarn end depending in the bore of the take-up tube from the top of the bobbin is blown upward outside the bobbin. Then, a suction pipe waiting above the bobbin catches the yarn end and takes the yarn end to a yarn joining device, not shown. Each winding unit $U_i$ is provided with a traverse drum 19 and a yarn clearer to wind a yarn unwound from the spinning bobbin in a yarn package 20. As shown in FIG. 6, empty bobbins removed from the winding units $U_i$ are mounted on the trays 3 and are conveyed together with the trays 3 along the empty bobbin conveying path 2 in the direction of an arrow 12 to an automatic bobbin feeder BF.

The automatic bobbin feeder BF puts a spinning bobbin on a tray 3, puts the yarn end of the spinning bobbin into the bore of the take-up tube of the spinning bobbin, and then delivers the tray 3 mounted with the spinning bobbin to the bobbin conveying path 1. The automatic bobbin feeder BF delivers diminished bobbins removed from the winding units $U_i$ among bobbins delivered thereto again to the spinning bobbin conveying path 1. The automatic bobbin feeder BF stores the total number of trays for the bobbins of a yarn lot and counts the number of empty trays delivered thereto from the empty bobbin conveying path 2.

Referring again to FIG. 5, an ejecting lever 42 ejects a bobbin 4 from the winding unit $U_i$ at the final stage of the winding operation for the bobbins of the yarn lot in process in case a diminished bobbin 4 having yarn insufficient to wind a full yarn package remains in the winding unit and there is no spinning bobbin left when a full yarn package is finished. The diminished bobbin 4 ejected from the winding unit $U_i$ when a full yarn package is finished on the winding unit $U_i$ after the start of operation for changing yarn lot is fed to other winding unit $U_i$ still in operation. The winding unit $U_i$ still in operation takes in the diminished bobbin 4 automatically by means of the guide plates 6, 7 and 8 and the rotary disk 9. In FIG. 5, indicated at GL is a green pilot lamp which flickers when a full yarn package is finished on the winding unit.

Figure 7:
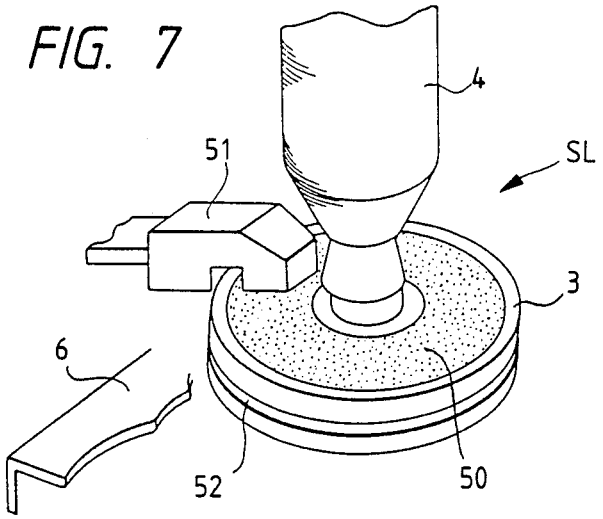
FIG. 7 is a fragmentary perspective view of a tray (lot) selecting mechanism.
Figure 8:
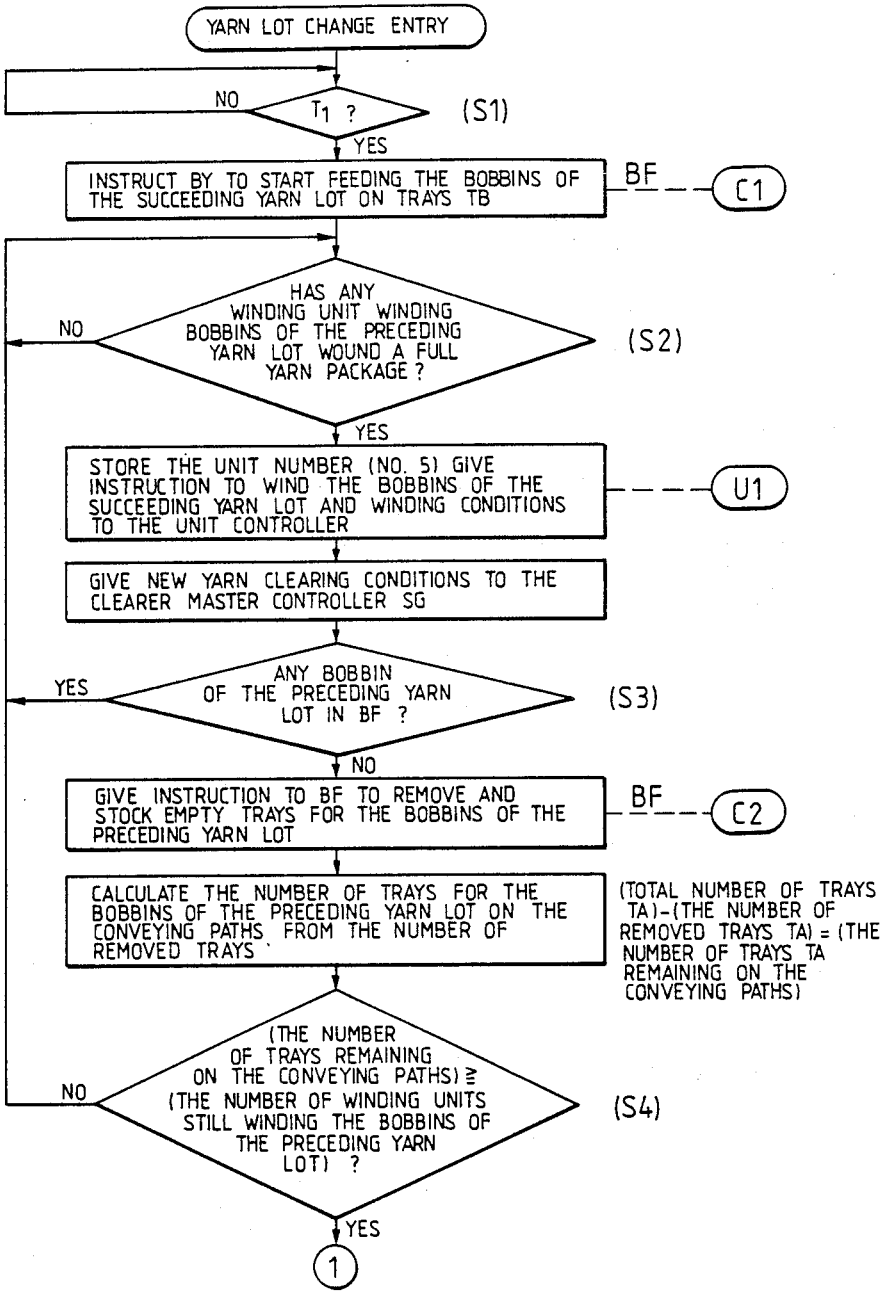
FIGS. 8 to 10 are flow chart showing steps of yarn lot change control operation to be executed by a master controller.
Figure 9:
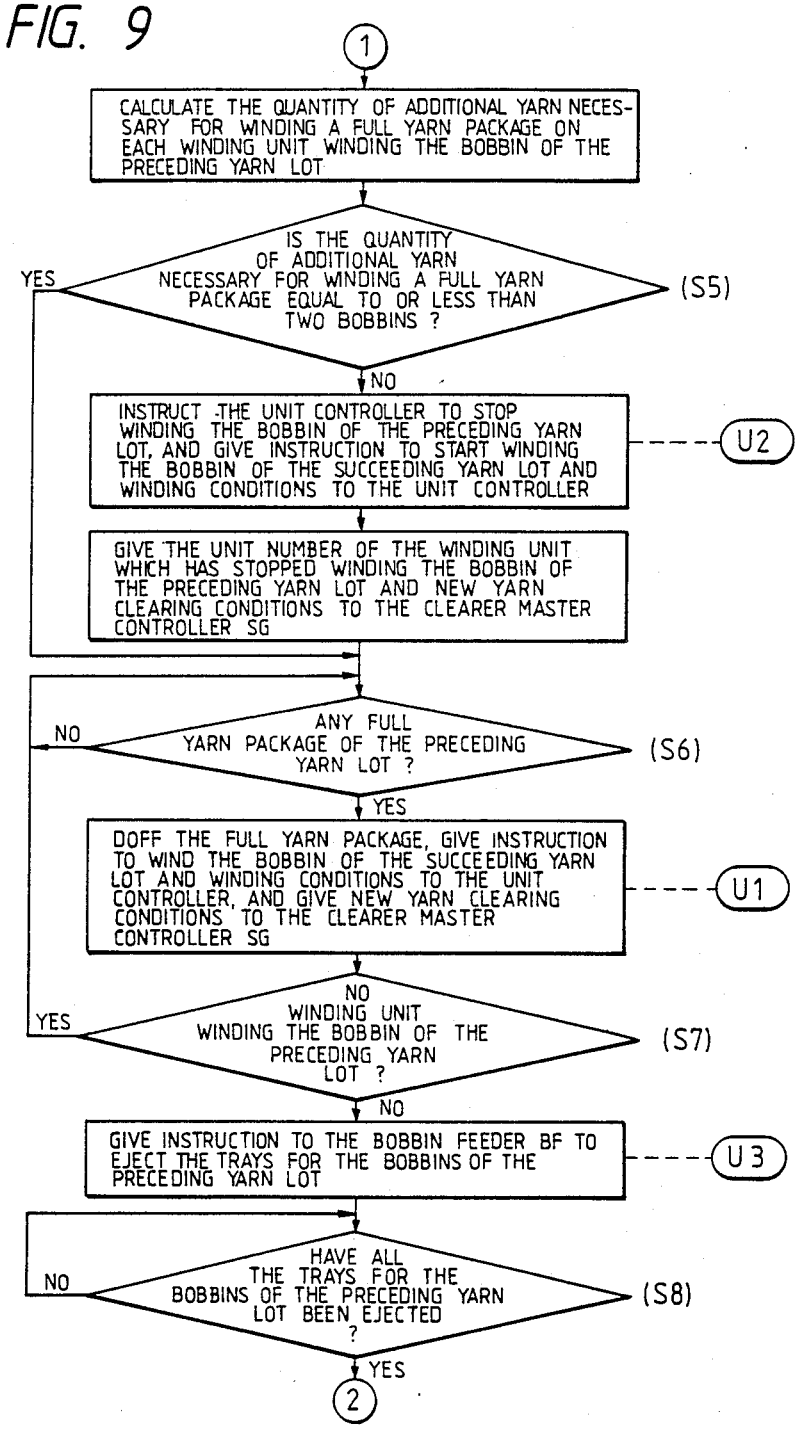
Figure 10:
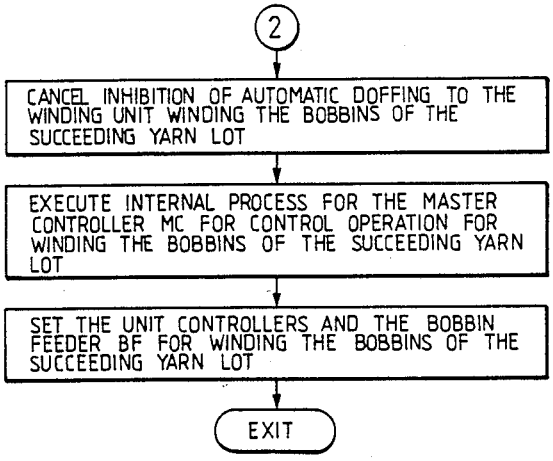

A tray selecting mechanism is provided at the entrance of the feed path 5 of each winding unit $U_i$. The tray selecting mechanism discriminates between the trays carrying the bobbins of the preceding yarn lot and those carrying the bobbins of the succeeding yarn lot and allows only the tray carrying the bobbin of a specified yarn lot to enter the feed path 5. The tray selecting mechanism may be either a purely mechanical mechanism or an electromechanical mechanism comprising an electronic unit and a mechanical unit in combination. For example, an electromechanical tray selecting mechanism SL is shown in FIG. 7. A read head 51 reads a yarn lot identification mark provided on a magnetic sheet 50 applied to the upper surface of the tray 3 to identify the bobbin 4. When the bobbin 4 identified by the tray selecting mechanism SL is not to be fed to the corresponding winding unit, the movable guide plate 6 is moved to a position where the movable guide plate 6 coincides in height with an annular groove 52 formed in the circumference of the tray 3, so that the tray 3 carrying the bobbin 4 is conveyed further along the bobbin conveying path 1 passing by the winding unit. When the bobbin 4 is to be fed to the winding unit, the movable guide plate 6 is moved to a position where the movable guide plate 6 interfere with the tray 3, so that the tray 3 carrying the bobbin 4 collides against the movable guide plate 6 and is guided by the movable guide plate 6 into the feed path 5. A gate, not shown, is provided at the entrance of the feed path 5 of each winding unit, and the gate is closed when a further bobbin need not be fed to the winding unit.

Figure 4:
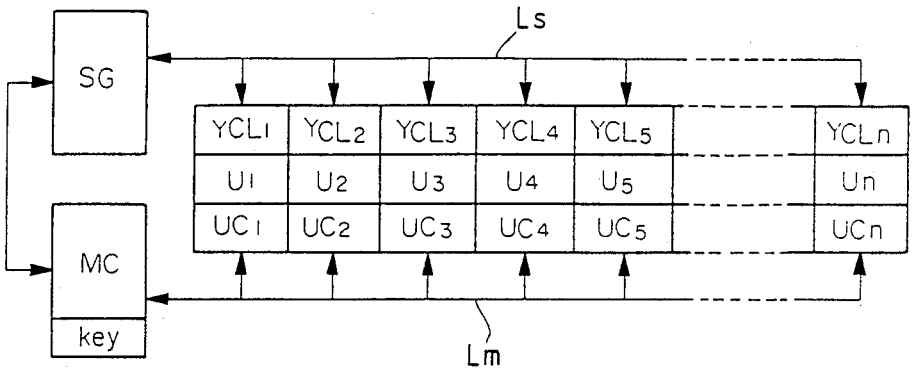
FIG. 4 is a block diagram of a control system for carrying out the present invention.

On the other hand, the automatic winder W is equipped with a communication system. Referring to FIG. 4, the communication system comprises unit controllers $UC_1$ to $UC_n$ respectively for controlling the winding units $U_1$ to $U_n$, a master controller MC for controlling the unit controllers, yarn clearers $YCL_1$ to $YCL_n$ provided respectively in the winding unit $U_1$ to $U_n$, and a master controller SG for controlling the yarn clearers $YCL_1$ to $YCL_n$. These controllers incorporate microcomputers.

The unit controllers $UC_i$ (i=1, 2, . . ., n) are connected individually through signal lines Lm to the master controller MC. The yarn clearers $YCL_i$ (i=1, 2, . . ., n) are connected individually through signal lines Ls to the master controller SG. The master controllers MC and SG communicate at a high frequency respectively with the unit controllers $UC_i$ and the yarn clearers $YCL_i$. The unit controller $UC_i$ controls all the operations of the corresponding winding unit $U_i$ and collects data representing the operation of the winding unit $U_i$. Most of basic operating conditions for the winding units $U_i$ are set in the master controller MC by operating a keyboard, and the master controller MC gives instructions according to the set operating conditions to the unit controllers $UC_i$. The master controller MC is capable of storing both the operating conditions for the preceding yarn lot and those for the succeeding yarn lot. The operating conditions stored in the master controller MC are transmitted, when necessary, to the master controller SG and the unit controllers $UC_i$.

General mode of operation of the automatic winder W in changing the preceding yarn lot, namely, a current yarn lot, for the succeeding yarn lot, namely, the next yarn lot, will be described hereinafter with reference to FIG. 2.

Figure 2:
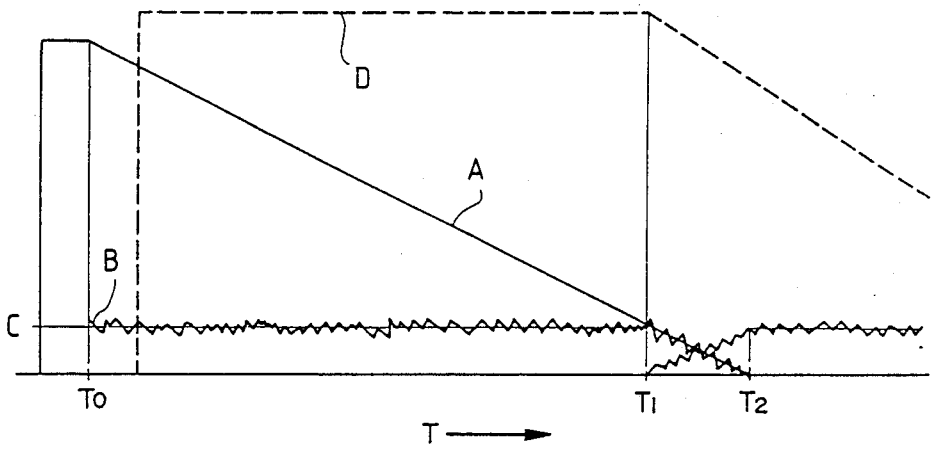
FIG. 2 is a diagram of assistance in explaining a yarn lot changing operation executed by an automatic winder.

In FIG. 2, a line A indicates the variation of the quantity of yarn on bobbins of the preceding yarn lot with time, a zigzag line B indicates the variation of the possible quantity of winding yarn of the preceding yarn lot of the automatic winder (all the winding units), a line C indicates the average value of the possible quantity of yarn of the preceding yarn lot, and a line D indicates the quantity of yarn of the succeeding yarn lot to be subjected to winding on the automatic winder. The residual quantity A of yarn of the preceding yarn lot starts decreasing with time from time $T_0$ when the automatic winder starts winding the yarn of the preceding yarn lot. Suppose that the yarn lot changing operation is started at time $T_1$ when the line A intersects the line B and the line B is positioned over the line A. When each winding unit continue to wind the yarn supplied from a bobbin of the preceding yarn lot subsequently to the doffing of a full yarn package after the time $T_1$, many short yarn packages of the preceding yarn lot will be produced.

Accordingly, spinning bobbins of the succeeding yarn lot are fed after the time $T_1$, and the winding unit which has wound a full yarn package of the preceding yarn lot after the time $T_1$, namely, the winding unit which is unable to wind a full yarn package of the preceding yarn lot after the time $T_1$, starts winding bobbins of the succeeding yarn lot. Consequently, the residual quantity D of yarn of the succeeding yarn lot starts decreasing from the time $T_1$, some winding units wind yarn packages of the preceding yarn lot and the rest of the winding units wind yarn packages of the succeeding yarn lot in a period between the time $T_1$ and time $T_2$ where yarn lot change is completed, and all the winding units wind yarn packages of the succeeding yarn lot after the time $T_2$.

Figure 3:
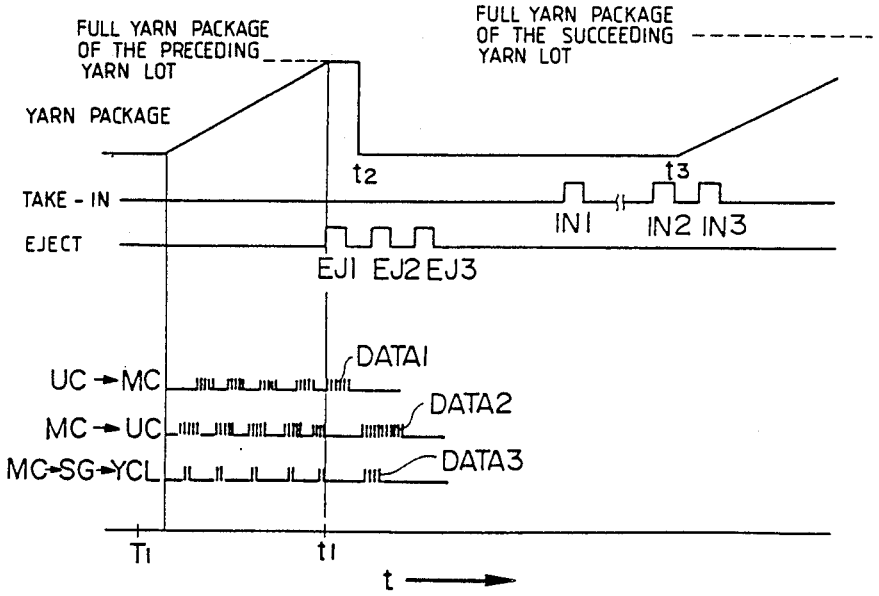
FIG. 3 is a timing chart of assistance in explaining yarn lot changing operation of a winding unit.

Mode of operation of one of the winding units in changing yarn lot will be described hereinafter with reference to FIG. 3. Suppose that the winding unit completed a full yarn package of the preceding yarn lot at time $t_1$ after the time $T_1$. Then, the unit controller UC of the winding unit sends a full yarn package completion signal DATA1 to the master controller MC. At time $t_2$ after doffing, the master controller MC gives an instruction to wind yarn packages of the succeeding yarn lot and winding condition data DATA2 to the unit controller UC. The master controller MC gives new yarn clearer setting data DATA3 through the master controller SG to the yarn clearer YCL.

Upon the reception of the instruction to wind yarn packages of the succeeding yarn lot and the winding condition data DATA2, the unit controller UC provides bobbin ejecting commands EJ1, EJ2 and EJ3 to eject the diminished cop and stock bobbins from the winding unit. Then, the tray selecting mechanism provided at the feed path 5 is set for selecting trays mounted with bobbins of the succeeding yarn lot, and then the unit controller UC provides bobbin take-in signals IN1, IN2 and IN3 to take bobbins of the succeeding yarn lot into the feed path 5. Then, the unit controller UC starts the winding unit at time $t_3$ for winding a yarn package of the succeeding yarn lot.

The operation of the master controller MC and the operation of the winding unit in changing yarn lot will be described with reference to FIGS. 8 to 14.

(1) Master Controller MC (FIGS. 8 to 10):

The master controller MC decides in step S1, on the basis of information given thereto from the unit controllers UC, whether or not the residual quantity of yarn on the bobbins of the preceding yarn lot has decreased to a quantity at the time $T_1$ (FIG. 2). When the decision in step S1 is affirmative, the master controller MC gives an instruction to the bobbin feeder BF (FIG. 6) to stop feeding trays TA for the bobbins of the preceding yarn lot and to start feeding trays TB for the bobbins of the succeeding yarn lot. Then, the bobbin feeder BF starts feeding the trays TB mounted with the bobbins of the succeeding yarn lot to the bobbin conveying path 1 (C1). In this state, both the bobbins of the preceding yarn lot mounted on the trays TA and the bobbins of the succeeding yarn lot mounted on the trays TB are conveyed on the bobbin conveying path 1.

Then, in step S2, the master controller decides whether or not there is a winding unit which has completed a full yarn package of the preceding yarn lot. Upon the completion of winding up a full yarn package on the winding unit, for example, the winding unit NO. 5, the corresponding unit controller UC, namely, the unit controller $UC_5$, sends the full yarn package completion signal DATA1 (FIG. 3) to the master controller MC. The master controller MC stores the full yarn package completion signal DATA1, and then gives an instruction to start winding the bobbins of the succeeding yarn lot and winding conditions DATA2 (FIG. 3) for winding the bobbins of the succeeding yarn lot to the unit controller $UC_5$. Upon the reception of the instruction and the winding conditions DATA2, the unit controller $UC_5$ executes steps of control program shown in FIGS. 11 and 12 (U1). The master controller MC gives new yarn clearer setting conditions DATA3 (FIG. 3) for the yarn clearer $YCL_5$ through the master controller SG for the yarn clearers to the unit controller $UC_5$. Thus, the winding unit No 5 is set for winding the bobbins of the succeeding yarn lot.

Then, in step S3, the master controller makes a query if there is any bobbin of the preceding yarn lot left in the bobbin feeder BF. When the response is affirmative, the master controller MC decides that there is no possibility that short yarn packages are wound, and the control operation returns to step S2. When there is no bobbin of the preceding yarn lot is left in the bobbin feeder BF, it is possible that short yarn packages of the preceding yarn lot are wound. Therefore, the control operation advances to the next step. In the next step, the master controller MC instructs the bobbin feeder BF to remove the empty trays TA for the bobbins of the preceding yarn lot and to store the removed empty trays TA in a tray stocker provided in the bobbin feeder BF. Then, the bobbin feeder BF removes the empty trays TA for the bobbins of the preceding yarn lot returned thereto along the empty bobbin conveying path 2 and stocks the removed empty trays TA in the tray stocker (C2). Subsequently, the master controller MC calculates the number of trays TA for the bobbins of the preceding yarn lot remaining on the bobbin conveying path 1 by using an expression:

(The number of trays TA remaining on the conveying paths)=(The total number of the trays TA) - (the number of removed trays TA) The total number of the trays TA is stored previously in the master controller MC.

In step S4, the master controller MC makes a query if the calculated number of the trays TA for the preceding yarn lot remaining on the conveying paths is more than three times the number of the winding unit presently winding the bobbins of the preceding yarn lot, because each winding unit $U_i$ is able to stock three bobbins including a bobbin in process. When the response in step S4 is negative, the control operation returns to step S2 to continue the present mode of winding operation, because only a small number of bobbins of the preceding yarn lot remain on the automatic winder. When the response in step S4 is affirmative, the master controller MC decides that sufficient bobbins of the preceding yarn lot remain on the automatic winder, and then calculates the additional quantity of yarn necessary for winding a full yarn package on each winding unit to estimate the possibility of winding short yarn packages.

Then, a decision is made in step S5 if the additional quantity of yarn necessary for winding a full yarn package on each winding unit corresponds to two bobbins or less. When the decision in step S5 is affirmative, the control operation jumps to step S6. In this state, the winding unit continues winding the bobbin of the preceding yarn lot and the gate of the winding unit is open to allow the bobbins of the preceding yarn lot to be taken into the feed path 5 of the winding unit, and the diminished bobbin of the preceding yarn lot ejected from the winding unit which has stopped winding the bobbins of the preceding yarn lot is taken into the feed path 5 of the winding unit still winding the bobbin of the preceding yarn lot. When the decision in step S5 is negative, short yarn packages are wound inevitably. Therefore, the master controller MC stops the winding operation of the winding unit before the yarn package in process on the winding unit increases to a full yarn package, and then gives an instruction to start winding the bobbins of the succeeding yarn lot and winding conditions for winding the bobbins of the succeeding yarn lot to the unit controller $UC_i$ of the relevant winding unit. This procedure is different from that of step S2 and the following steps in that the winding operation of the winding unit is stopped before the yarn package in process on the winding unit increases to a full yarn package. Upon the reception of the instruction to wind the bobbins of the succeeding yarn lot and the winding conditions, the unit controller $UC_i$ executes steps of control operation shown in FIGS. 13 and 14 (U2). The master controller MC gives information including the unit number of the winding unit which has stopped winding the bobbin of the preceding yarn lot and yarn clearing conditions for the yarn of the succeeding yarn lot to the master controller SG.

Then, in step S6, a decision is made if the winding unit winding the bobbin of the preceding yarn lot and requiring two or less bobbins to wind a full yarn package has finished winding a full yarn package. When the decision in step S6 is affirmative, similarly to the procedure in step S2 and the following steps, an instruction to wind the bobbins of the succeeding yarn lot and winding conditions are given after doffing the fully yarn package to the unit controller of the winding unit, and new yarn clearing conditions are given to the master controller SG.

In step S7, a decision is made if there is still any winding unit winding the bobbin of the preceding yarn lot. Steps S6 and S7 are repeated until all the winding units end winding the bobbins of the preceding yarn lot. When the decision in step S7 is affirmative, the master controller MC instructs the bobbin feeder BF to eject the trays for the bobbins of the preceding yarn lot (C3).

A decision is made in step S8 if all the trays for the bobbins of the preceding yarn lot have been ejected. When the decision in step S8 is affirmative, inhibition of automatic doffing AD for the winding units which have previously started winding the bobbins of the succeeding yarn lot is cancelled. Then, the master controller MC executes internal processes to change the preceding yarn lot for the succeeding yarn lot, the master controller MC give instructions to the unit controllers and the bobbin feeder BF to establish a control mode for the succeeding yarn lot, and then the yarn lot changing control operation is completed at the time $T_2$ (FIG. 2).

Figure 12:
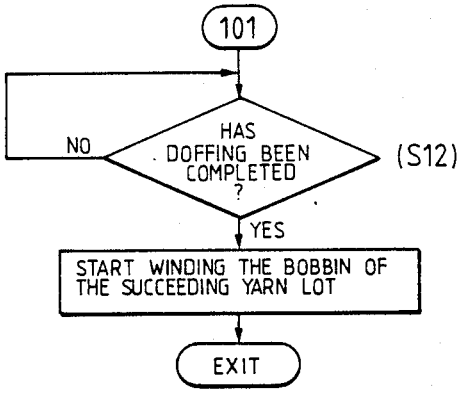
FIGS. 11 to 14 are flow charts showing steps of yarn lot change operation to be carried out by the winding unit of the automatic winder.
Figure 11:
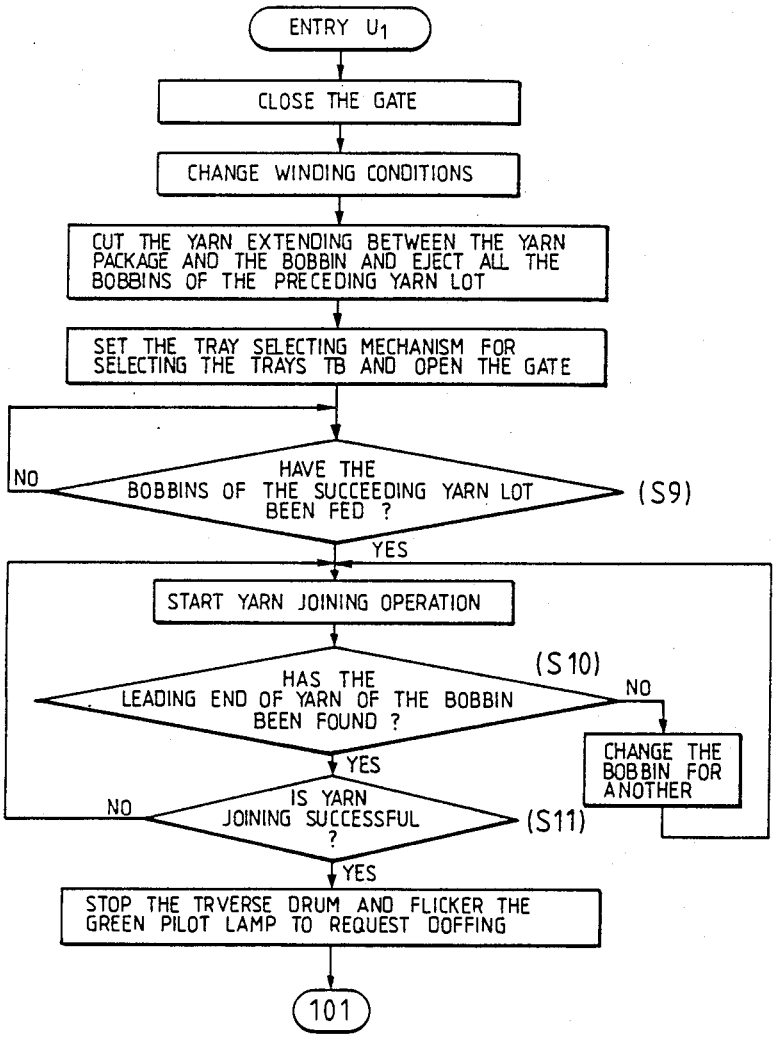

(2) Winding Unit (FIGS. 11 to 14):

First, a full yarn package doffing control routine designated as "ENTRY $U_1$" will be described with reference to FIGS. 11 and 12. A short yarn package doffing control routine is slightly different from the full yarn package doffing control routine.

The gate, not shown, provided at the entrance of the feed path of the winding unit which has wound up a full yarn package is closed to prepare for winding the bobbins of the succeeding yarn lot, and then the winding conditions of the winding unit are set for winding the bobbins of the succeeding yarn lot. Then, the yarn extending between the full yarn package 20 and the bobbin 4 is cut, and then the ejecting lever 42 is operated three times as indicated at EJ1, EJ2 and EJ3 in FIG. 3 to eject all the three bobbins remaining in the winding unit to the empty bobbin conveying path 2. The bobbins ejected to the empty bobbin conveying path 2 are delivered again to the bobbin conveying path 1 and are taken automatically into the feed paths 5 of the winding units which are still set for taking in the trays TA. The tray selecting mechanism SL (FIG. 7) of the winding unit which has wound a full yarn package is set for selecting the trays TB, and then the gate is opened. Consequently, the bobbins of the succeeding yarn lot mounted on the trays TB and conveyed along the bobbin conveying path 1 are taken into the feed path of the winding unit.

In step S9, a decision is made if the bobbin of the succeeding yarn lot has been taken into the feed path 5 of the winding unit. When the decision in step S9 is affirmative, a yarn joining operation is started. In step S10, a decision is made if the leading yarn end of the bobbin is found. When the decision in step S10 is negative, the bobbin is changed for a stock bobbin, the yarn joining operation is started again and step S10 is executed again. This procedure is repeated until the leading yarn end is found. When the decision in step S10 is affirmative, a decision is made in step S11 if the yarn joining operation has been achieved successfully. When the decision in step S11 is negative, the joining operation is repeated until the joining operation is achieved successfully. When the decision in step S11 is affirmative, the traverse drum 19 is stopped, and the green pilot lamp GL is made to flicker to request doffing. Then, an automatic doffer AD, not shown, arrives at the winding unit and doffs the full yarn package. In step S12 a decision is made if the doffing operation has been accomplished. When the decision in step S12 is affirmative, the winding unit is started to wind the bobbin of the succeeding yarn lot.

Figure 14:
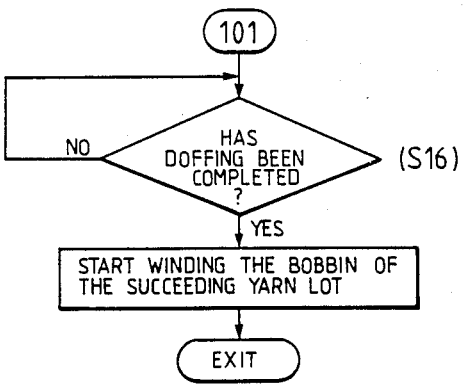
Figure 13:
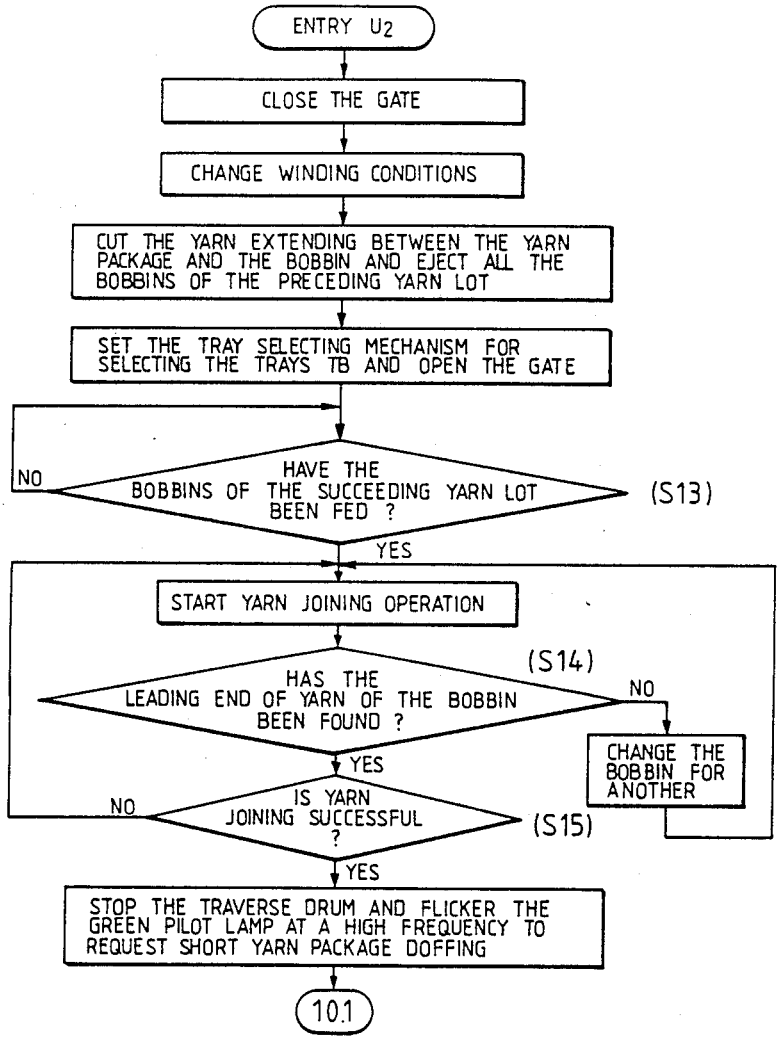

Steps of control operation for doffing a short yarn package designated as "ENTRY $U_2$" will be described hereinafter with reference to FIGS. 13 and 14. This control operation is substantially the same as that shown in FIGS. 11 and 12, except that the green pilot lamp flickers when a decision is made in step S15 that the yarn joining operation has been achieved successfully at a frequency for requesting doffing a short yarn package higher than the frequency at which the green pilot lamp flickers for requesting doffing a full yarn package.

As is apparent from the foregoing description, according to the present invention, during the transient period of yarn lot changing operation at the final stage of winding the bobbins of the preceding yarn lot, the operating mode of the winding unit which has wound up a full yarn package of the preceding yarn lot is changed from that for winding the bobbins of the preceding yarn lot to that for winding the bobbins of the succeeding yarn lot, so that the winding units start winding the bobbins of the succeeding yarn lot sequentially. Accordingly, no winding unit remains inoperative during the yarn lot changing period and thereby the reduction of the operating efficiency of the winding units is prevented effectively. Furthermore, since the diminished bobbins of the preceding yarn lot are ejected from the winding unit which has wound up a full yarn package and is fed to other winding unit still winding the bobbin of the preceding yarn lot, the number of short yarn packages is reduced to a minimum.

What is claimed is:

1. A method of operating an automatic winder having a plurality of winding units each provided with a bobbin selecting mechanism, in changing yarn lot, comprising steps of:

feeding spinning bobbins of the succeeding lot to the automatic winder to wind the yarn of the preceding yarn lot and that of the succeeding yarn lot simultaneously on the automatic winder when the quantity of remaining yarn of the preceding lot in process is diminished below a quantity of yarn necessary for winding up full yarn packages on all the winding units of the automatic winder;

removing remaining bobbins of the preceding yarn lot from the winding unit when a full yarn package of the preceding yarn lot is finished on the same winding unit;

feeding the remaining bobbins removed from the winding unit to one of the other winding units in operation for winding the yarn of the preceding yarn lot to finish a full yarn package of the preceding yarn lot; and changing over the mode of operation of the yarn package selecting mechanism of the same winding unit which has finished winding the yarn of the preceding yarn lot and from which the remaining bobbin of the preceding yarn lot has been removed from a mode for selecting the bobbins of the preceding yarn lot to a mode for selecting the bobbin of the succeeding yarn lot to start winding the yarn of the succeeding yarn lot on the same winding unit.

2. An automatic winder having a plurality of winding units, a spinning bobbin conveying path and an empty bobbin conveying path extending along the plurality of winding units and operable with spinning bobbins of a preceding yarn lot and spinning bobbins of a succeeding yarn lot mounted on trays for transportation on the spinning bobbin conveying path to be rewound on a yarn package at each winding unit, the automatic winder comprising:

a plurality of tray selecting mechanism, each tray selecting mechanism comprising discriminating means for discriminating between trays carrying the bobbins of the preceding yarn lot and those carrying the bobbins of the succeeding yarn lot and selecting means for allowing only the tray carrying the bobbin of a specified yarn lot to enter a winding unit;

wherein each winding unit has a bobbin entrance and one of the tray selecting mechanisms provided at the bobbin entrance.

3. The automatic winder as claimed in claim 2, wherein each winding unit further comprises a bobbin ejecting device operable to eject bobbins remaining in the a winding unit when a full yarn package is finished on the winding unit.

4. The automatic winder as claimed in claim 2, wherein said tray selecting mechanism is a purely mechanical mechanism.

5. The automatic winder as claimed in claim 2, wherein said trays electing mechanism is an electromechanical mechanism comprising an electronic unit and a mechanical unit in combination.

6. The automatic winder as claimed in claim 5, wherein the trays are provided with an annular groove about the circumference of the trays, and wherein the discriminating means comprises a yarn lot identification mechanism including a magnetic sheet applied to the upper surface of the tray and a read head for reading the magnetic sheet to identify the spinning bobbin, and the selecting means comprises a tray selecting device including a movable guide plate movable to a position to coincide with the annular groove provided about the circumference of the tray and movable to a position to interfere with the tray.

7. The automatic winder as claimed in claim 3, wherein said automatic winder further comprises a communication system comprising:

unit controllers for controlling the winding units, respectively, a first master controller for controlling the unit controllers, yarn clearers provided in the winding units, respectively, and a second master controller for controlling the yarn clearers, wherein said controllers having microcomputers and being operable for giving instructions to the tray selecting mechanism and the bobbin ejecting device.

8. A method of operating a plurality of winding units to wind yarn from bobbins of first and second yarn lots to yarn packages associated with each winding unit, the method comprising the steps of:

winding yarn with each winding unit from bobbins of the first yarn lot to the yarn packages associated with the winding units;

determining a first quantity of yarn, the first quantity of yarn being the quantity of yarn necessary for all of the winding units which are winding yarn from bobbins of the first yarn lot to fully wind the yarn packages associated with the winding units;

determining a second quantity of yarn, the second quantity of yarn being the quantity of yarn remaining on the bobbins of the first yarn lot;

detecting the occurrence of the second quantity of yarn being diminished below the first quantity of yarn; and winding yarn, with at least one winding unit, from bobbins of the second yarn lot while winding yarn, with at least one other winding unit, from bobbins of the first yarn lot upon the detection of the occurrence of the second quantity of yarn being diminished below the first quantity of yarn.

9. A method as claimed in claim 8, wherein each winding unit has an associated bobbin receiver and wherein:

the step of winding yarn with each winding unit comprises the step of receiving a plurality of bobbins of the first yarn lot with the bobbin receiver associated with each winding unit; and the step of winding yarn, with at least one winding unit, from bobbins of the second yarn lot comprises the steps of removing at least one bobbin of the first yarn lot from the bobbin receiver associated with the at least one winding unit, and receiving a plurality of bobbins of the second yarn lot with the bobbin receiver associated with the at least one winding unit.

10. A method as claimed in claim 9, further comprising the step of supplying removed bobbins to the at least one other winding unit winding yarn of the first yarn lot.

11. A method as claimed in claim 10, wherein the step of winding yarn, from bobbins of the second yarn lot further comprises the steps of:

detecting the occurrence of a full yarn package associated with one of the winding units;

doffing the detected full yarn package; and winding yarn from bobbins of the second yarn lot with the winding unit associated with the doffed full yarn package.

12. A method as claimed in claim 9, wherein a bobbin conveying path operable to convey bobbins of the first and second yarn lots is associated with the winding units, the method further comprising the step of:

feeding bobbins of the second yarn lot from the bobbin conveying path to the bobbin receiver associated with the at least one winding unit winding yarn from bobbins of the second yarn lot; and feeding bobbins of the first yarn lot from the bobbin conveying path to the bobbin receiver associated with the at least one other winding unit winding yarn from bobbins of the first yarn lot.

13. A method as claimed in claim 12, wherein the step of feeding bobbins of the second yarn lot comprises the step of selecting bobbins of the second yarn lot from the bobbins conveyed by the bobbin conveying path.

14. A method as claimed in claim 8, wherein the step of winding yarn, from bobbins of the second yarn lot comprises the steps of:

detecting the occurrence of a full yarn package associated with one of the winding units winding yarn from bobbins of the first yarn lot;

doffing the detected full yarn package; and winding yarn from bobbins of the second yarn lot with the winding unit associated with the doffed full yarn package.

15. An automatic winder having a plurality of winding units, each of which is operable for winding yarn from bobbins of a first yarn lot and bobbins of a second yarn lot, the automatic winder comprising:

a plurality of bobbin receivers corresponding in number with the plurality of winding units, each bobbin receiver being associated with one of the winding units; and a plurality of bobbin selecting mechanisms corresponding in number with the plurality of winding units, each bobbin selecting mechanism being associated with one of the bobbin receivers, each bobbin selecting mechanism having selecting means, operable in a first mode, for feeding bobbins of the first yarn lot to the associated bobbin receiver and, operable in a second mode, for feeding bobbins of the second yarn lot to the associated bobbin receiver.

16. An automatic winder as claimed in claim 15, further comprising:

a spinning bobbin conveying path; and an empty bobbin conveying path;

wherein each bobbin receiver comprises a bobbin feed path arranged adjacent the associated winding unit and extending from the spinning bobbin conveying path to the empty bobbin conveying path.

17. An automatic winder as claimed in claim 15, further comprising:

bobbin conveying means for conveying bobbins of the first and second yarn lots;

wherein each bobbin receiver comprises a bobbin receiving means for receiving bobbins of the first and second yarn lots conveyed by the bobbin conveying means.

18. An automatic winder as claimed in claim 15, wherein each winding unit is associated with a yarn package and operates to wind the yarn package, and wherein the automatic winder further comprises:

first determining means for determining the amount of yarn remaining on the bobbins of the first yarn lot;

second determining means for determining the amount of yarn required to complete the winding of full yarn packages with all of the winding units winding yarn from bobbins of the first lot;

detecting means for detecting the occurrence of the amount of yarn determined by the first determining means being diminished below at the amount of yarn determined by the second determining means; and control means, responsive to the detecting means, for controlling the selecting means of each of the bobbin selecting mechanisms to operate in the first mode until the occurrence of the amount of yarn determined by the first determining means being diminished below the amount of yarn determined by the second determining means, and for controlling the selecting means of at least one bobbin selecting mechanism to operate in the second mode upon the occurrence of the amount of yarn determined by the first determining means being diminished below the amount of yarn determined by the second determining means.

* * * * *